United States Patent [19]

Quick

[11] Patent Number: 4,863,593

[45] Date of Patent: Sep. 5, 1989

[54] BATTERY POWERED VACUUM UNIT

[75] Inventor: Thomas J. Quick, Peninsula, Ohio

[73] Assignee: The University of Akron, Akron, Ohio

[21] Appl. No.: 152,314

[22] Filed: Feb. 4, 1988

Related U.S. Application Data

[63] Continuation-in-part of Ser. No. 792,650, Oct. 29, 1985, abandoned.

[51] Int. Cl.[4] ..... B01D 29/00

[52] U.S. Cl. ..... 210/136; 210/137; 210/138; 210/406; 210/416.1; 210/474; 417/12; 417/411; 422/101

[58] Field of Search ..... 210/138, 258, 406, 416.1, 210/474, 477, 136, 137; 422/49, 101; 417/411, 12, 313; 15/344; 184/18, 24, 109; 92/128

[56] References Cited

U.S. PATENT DOCUMENTS

| | | | |
|---|---|---|---|
| 1,462,855 | 7/1923 | Gerleman | 184/18 |
| 2,126,625 | 8/1938 | Eggleston | 210/406 |
| 2,818,815 | 1/1958 | Corneil | 418/45 |
| 3,776,666 | 12/1973 | Ludwig | 417/411 |
| 3,910,725 | 10/1975 | Rule | 417/234 |
| 4,063,824 | 12/1977 | Baker et al | 417/43 |
| 4,527,953 | 7/1985 | Baker et al. | 417/38 |

OTHER PUBLICATIONS

Siegel, "In Situ Recovery of Suspended Sediments from Streams", J. P. Geological Education, vol. 33, pp. 132–133, 1985.

Skougstad et al. "Methods for Determination of Inorganic Substances in Water and Fluvial Sediments", From Techniques of Water-Resources Investigations of the USGS, Book 5, pp. 3–4, 1979.

Brown et al. "Methods for Collection and Analysis of Water Samples for Dissolved Minerals and Gases", from Techniques of Water Resources Investigations of the USGS, Book 5, Chapter A1, 1979, pp. 4–18.

*Primary Examiner*—Peter Hruskoci
*Assistant Examiner*—Christopher Upton
*Attorney, Agent, or Firm*—Oldham & Oldham

[57] ABSTRACT

Battery powered vacuum unit, useful for suction filtration of water samples in the field. The vacuum unit comprises a miniature piston type air suction pump, driven by a small direct current (DC) motor which in turn is powered by a battery or other 12 volt DC power source. The motor may be controlled by a timer. The motor has a maximum power requirement of about 75 Watts and the suction pump has the ability to produce a vacuum of at least about 12.5 mm of mercury. The entire unit is preferably self-contained in a single housing, and preferably weighs no more than about 5 kilograms (11 pounds).

18 Claims, 5 Drawing Sheets

BATTERY POWERED VACUUM UNIT

CROSS REFERENCE TO RELATED APPLICATION

This application is a continuation-in-part of applicant's copending application ser. No. 06/792,650, filed Oct. 29, 1985, now abandoned.

TECHNICAL FIELD

This invention relates to suction filtration systems for field use and to vacuum units for use in suction filtration systems. More particularly this invention relates to novel battery powered vacuum units which are small enough to be carried from place to place by hand.

BACKGROUND ART

Water quality has become a matter of concern in recent years. Federal and State laws and regulations setting water quality standards have been adopted. These standards concern both suspended solids and dissolved matter; the latter is usually defined for regulator purposes as constituents which will pass through a 0.45 micrometer membrane filter. Large numbers of water samples have been collected from various sources and analyzed for the purpose of compliance with these standards. Some of these sources are in locations which are readily accessible to motor vehicles and machinery. Others can be reached only on foot.

The person collecting the water sample must decide whether to filter the sample in the field (i.e., at the site where the sample is collected) or simply to collect a sample and send it back to a laboratory for analysis. (On-site analyses are usually limited to a few determinations, such as temperature, pH, dissolved oxygen and specific conductance). A major advantage of filtration when suspended matter is to be studied is that the transport of large volumes of water can be avoided, since only the solids have to be sent back to the laboratory. Even when dissolved solids are of interest, an advantage of field filtration is that analytical results are usually more accurate if the sample is filtered in the field. This is pointed to, for example, in Brown, E; Skougstad, M. W. and Fishman, M. J., 1970, "Methods for Collection and Analysis of Water Samples for Dissolved Minerals and Gases", Techniques of Water Resources Investigations of The United States Geological Survey, Book 5, Chapter A1. This reference also described sampling methods and equipment to be used both when the sample is to be field-filtered and when it is not to be field-filtered. Whether or not the sample is field-filtered depends on the accessibility of the site and the equipment available.

Vehicle-mounted equipment (a gasoline engine-driven compressor, for example) can be used to separate suspended solids from water in accessible areas. Portable equipment is required in inaccessible areas. Such equipment includes, for example, a bicycle pump as disclosed in Brown et al., supra, page 16, another type of hand pump as disclosed in Siegel, F. R., *Journal of Geological Education,* 1985, vol. 33, pp. 132–133, or a battery powered portable peristaltic pump, also as disclosed in Siegel on page 132.

Each type of equipment described above has disadvantages which has limited its use. A peristaltic pump may be a Model WM-4-2w4 Sampler, made by Sigmamotor, Inc. of Middleport, New York and described in a brochure published by the manufacturer and in U.S. Pat. No. 2,818,815. The peristaltic pump can be used only for about 2 to 2.5 hours unless a battery recharger is available, according to Siegel. Siegel admits that his polypropylene hand pumps "are not made for extended use" and that their efficiency for vacuum filtration in the field diminishes after filtering 50 to 75 samples. The lack of any easily portable vacuum filtration equipment which can be used for filtering large numbers of samples in the field has limited studies on water sources in inaccessible areas and consequently has slowed compliance with water quality regulations.

SUMMARY OF THE INVENTION

An object of this invention is to provide an improved suction filtration apparatus for field use.

A related object of this invention is to provide an easily portable battery powered vacuum unit for the aforesaid suction filtration apparatus.

A more specific object of this invention is to provide a battery powered vacuum unit which can be carried from place to place by hand and which can be used for a large number of filtrations before it requires battery recharging or other servicing.

A further object of this invention is to provide a portable vacuum unit having a piston pump which can be lubricated easily without removing a housing wall.

The battery operated vacuum unit of this invention is capable of being carried from place to place by hand and comprises (a) a housing having therein a generally upright piston pump and a direct current electric motor for driving said pump, said pump including a cylinder having a reciprocable piston therein, an inlet port for air under reduced pressure and an outlet port for exhausting air to the atmosphere; (b) a tubular connection extending through a wall of said housing for attachment of a suction line; (c) a vacuum line extending from said tubular connection to said inlet port of said piston pump, said vacuum line including a water trap; and (d) means for introducing a lubricant into said cylinder without removal of any wall of said housing.

The suction filtration apparatus of this invention comprises a vessel for unfiltered water, a filter, a receiving vessel for filtered water, a suction port on the outlet or downstream side of the filter and a battery powered vacuum unit as aforedescribed, connected to the suction port via a suction line.

BEST MODE FOR CARRYING OUT THE INVENTION

Figure 1:
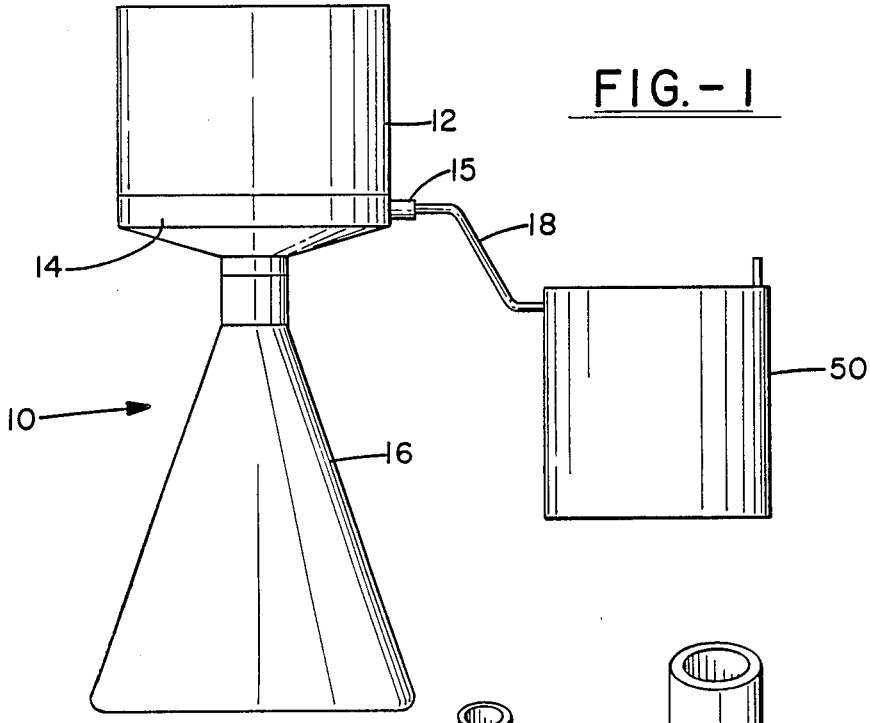
FIG. 1 is a diagrammatic illustration of a suction filtration apparatus of this invention in which the novel battery powered vacuum unit is shown diagramatically.

The overall apparatus of this invention will now be described with respect to FIG. 1. Referring to FIG. 1, the suction filtration apparatus of this invention comprises a filtration assembly 10, which in turn comprises an open top vessel or funnel 12 for unfiltered water, a filter 14 having a laterally extending suction port 15 below filter 14 and a receiving vessel 16 below vessel 12 for receiving filtered water; a flexible suction line 18 connected to suction port 15, and a battery powered vacuum unit 50 connected to the filter assembly 10 via suction line 18. The battery powered vacuum unit 50 is in accordance with this invention, and two embodiments thereof will be described in detail with respect to the remaining figures of the drawing.

The filtration assembly 10 is preferably a conventional suction filtration assembly of a size suitable for field use. The vessel 12 for untreated water may be, for example, an open top container or funnel. The filter 14 may be a 45 micrometer membrane filter. An opening size of 45 micrometers is generally desired for water quality determinations because "dissolved" and 37 suspended" are generally defined respectively as materials which pass through and materials which are retained on a 45 micrometer filter. (See for example Skougstad, M. W. et al., 1979, "Methods for Determination of Inorganic Substances in Water and Fluoral Sediments, Techniques of Water-Resources Investigations of The United States Geological Survey", book 5, chapter A1, pp. 3–4). Receiving vessel 16 may be an Erlenmeyer flask having a volume equal to that of a desired water sample (either one or two liters, for example). Port 15 is a short tube on the outlet side of filter 4 to which flexible tubing such as suction line 18 may be attached.

Figure 2:
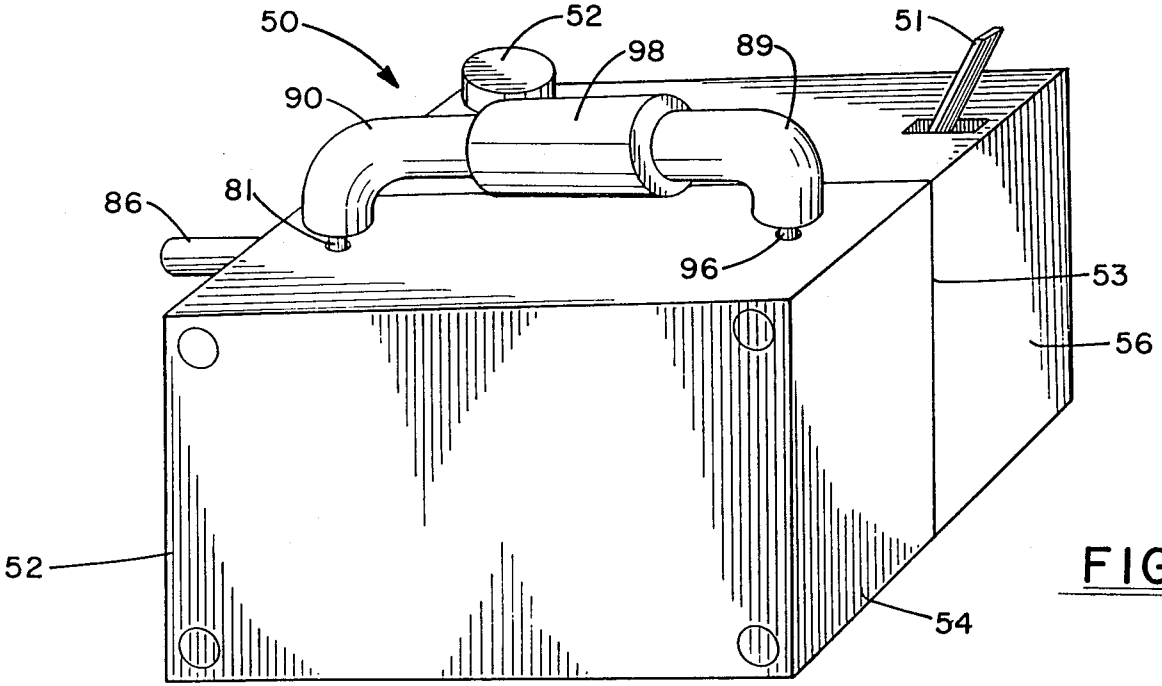
FIG. 2 is a perspective view of a battery powered vacuum unit according to a preferred embodiment of this invention.

The preferred embodiment of the invention will now be described with reference to FIGS. 2–7. Referring now to FIG. 2, a battery powered vacuum unit 50 according to this embodiment comprises a rectangular housing having top side and bottom walls, and a vertical partition 53 dividing the interior into a first section 54 for fluid handling components, e.g. a piston pump and electric motor, and a second section 56 for electrical components, e.g., a battery and a timer.

Figure 3:
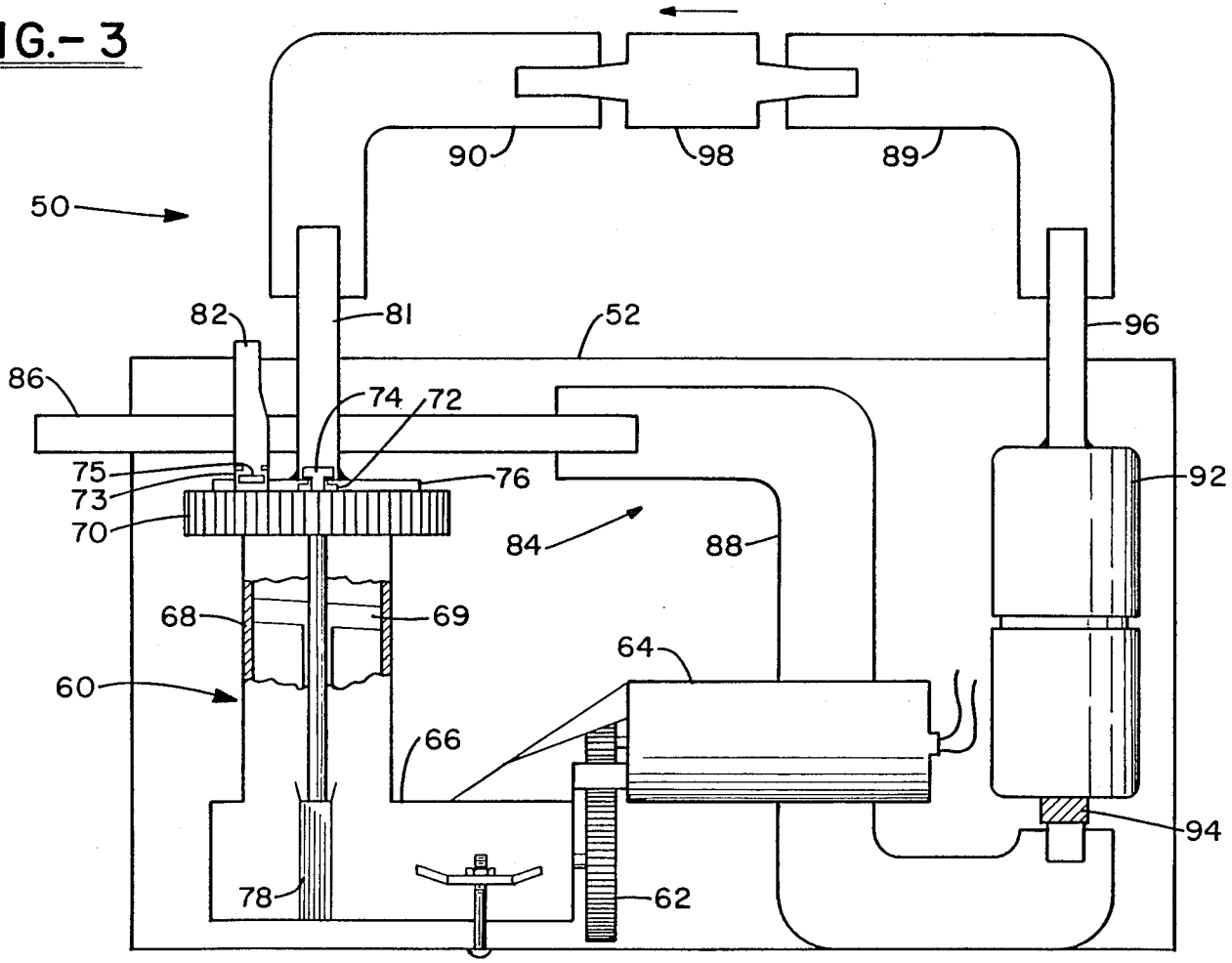
FIG. 3 is a front elevational view of the fluid handling portion of a vacuum unit according to the preferred embodiment of the invention, with the front wall of the housing removed.
Figure 4:
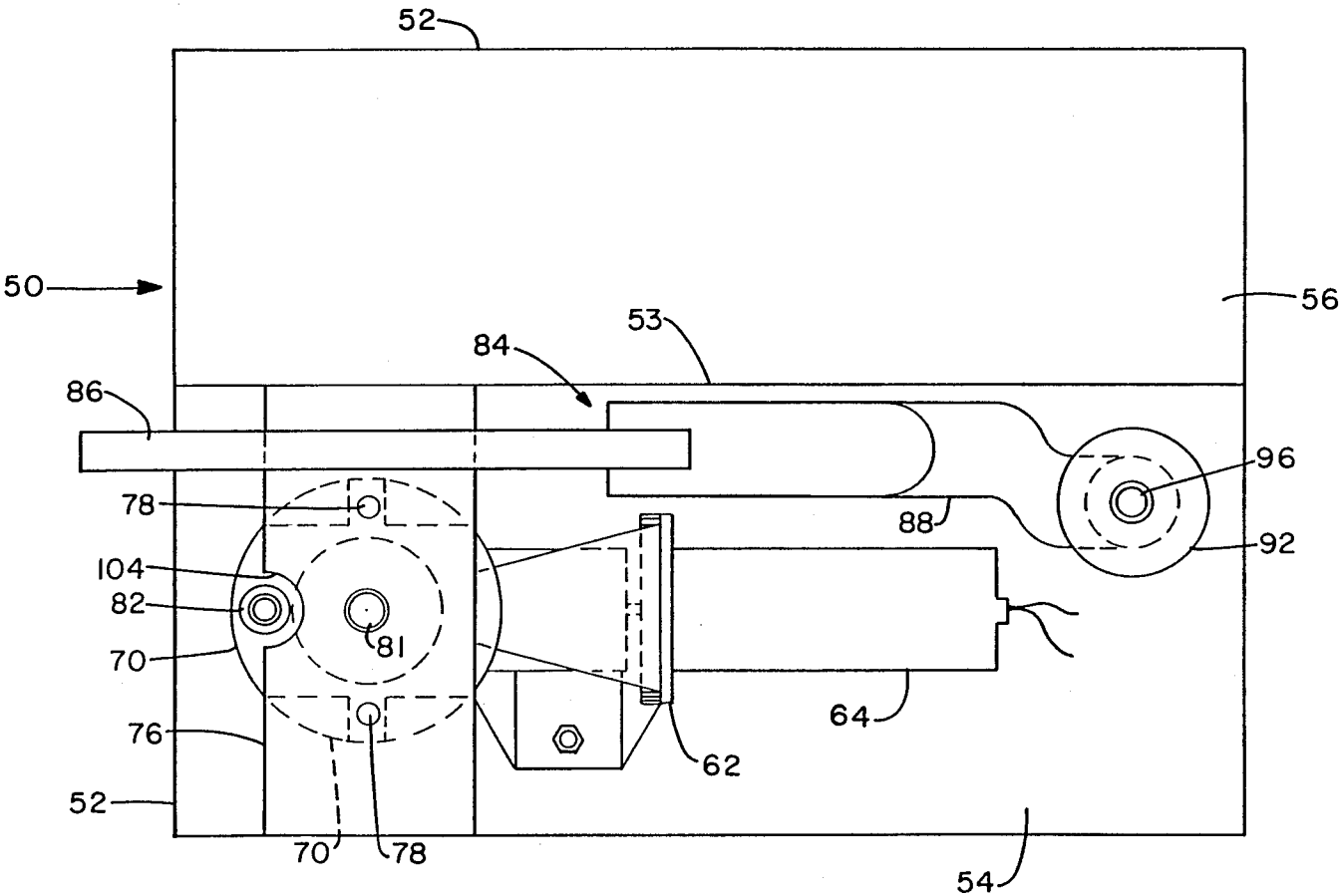
FIG. 4 is a plan view of the fluid handling portion of the vacuum unit of the preferred embodiment, with the top wall of the housing and the fluid passageways above the housing removed.

The components inside the first compartment 54 will now be described with reference to FIG. 2, 3 and 4. Referring especially to FIG. 3, a battery powered vacuum unit according to the second embodiment of this invention comprises a piston pump 60, reduction gearing 62, and a battery powered direct current drive motor 64, all shown in FIG. 3.

Piston pump 60 comprises a horizontally extending crankshaft housing 66 and an upright cylinder 68 which houses a piston 69. Cylinder 68 may have a bore of 1.7 cm, a stroke of 1.5 cm, and a displacement of 3.40 $cm^3$. The upper end of cylinder 68 is closed by a head 70 having cooling fins thereon, and having an inlet port 72 and an outlet port 73 extending therethrough. Air flow through these ports is controlled by inlet valve 74 and outlet vale 75, respectively. Cylinder 68 is held in place by means of a metal (preferably brass) plate 76 which abuts the top surface of head 70, and head screws 78. Head screw 78 extends through openings in brass plate 76 and head 70, and are received in internally screw threaded receptacles 80 which are integrally formed with cylinder 68 on the exterior thereof. Inlet tube 81 and outlet tube 82 are joined to the exterior of head 70 and extend upwardly therefrom. These tubes preferably extend through the top wall of having 52. Tubes 81 and 82 are aligned with inlet and outlet ports 72 and 73, respectively, to form air passageways extending from the interior of cylinder 68 to the outside.

Figure 5:
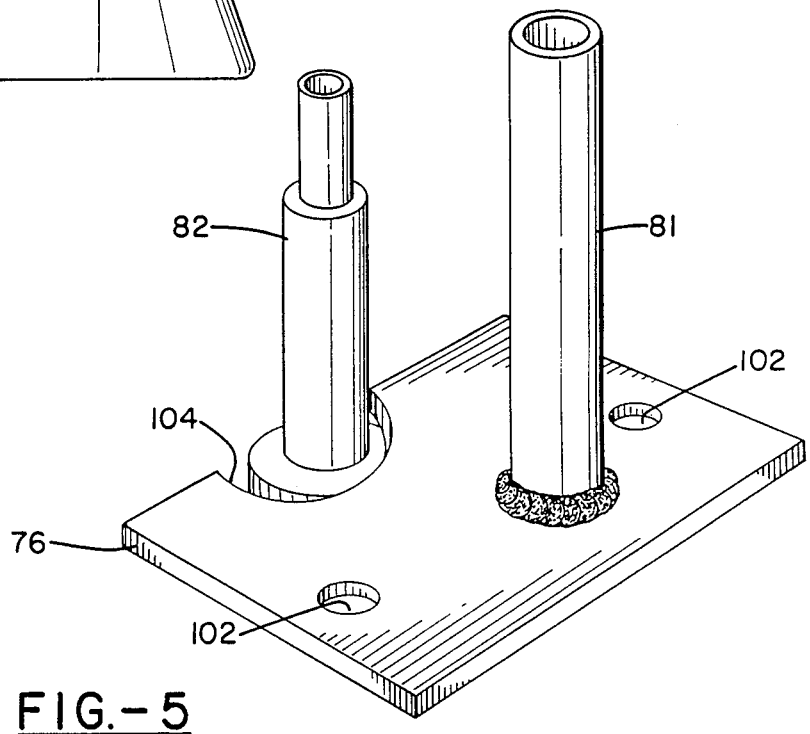
FIG. 5 is a detail perspective view of a portion of the vacuum unit according to the preferred embodiment of the invention.

A vacuum line, indicated generally as 84, includes a rigid tubular connection 86 of relatively small ($\frac{1}{4}''$) diameter and first, second and third tube sections 88, 89 and 90, respectively, all flexible and all of relatively large diameter. Tubular connection 86 extends through the wall of housing 52. The inlet end of first tube 86 outside is housing 52 and is adapted for attachment of suction line 18. First tube section 88, which is of generally "S" shape, is inside housing 52. Second and third tube sections 89 and 90 respectively, are outside housing 52, as shown in FIGS. 4 and 5. Interposed between the first tube section 88 and the second tube section 89 is a water trap 92 having inlet and outlet connections 94 and 96, respectively. These connections are connected to the first and second tube sections 88 and 89, respectively. Water trap 92 and its inlet connection 94 are inside housing 52; a portion of the outlet connection 96 extends to the outside. A check valve 98 is interposed between second and third tube sections 89 and 90, respectively. Check valve 98 permits flow only in the direction shown by the arrow, i.e. from right to left as shown in FIG. 3. The ends of third tube section 90 are connected to check valve 98 and the inlet tube 81 of piston pump 60, respectively. Since tube section 90 is flexible, it is removably attached to an inlet tube 81 of cylinder 68. Tube section 90 can be temporarily detached from inlet tube 81 to add lubricant (i.e., oil) to the interior of cylinder 68 via inlet tube, as will be described. The joint between tube section 90 and inlet tube 81, being outside housing 50, is readily accessible so that lubricant can be added without removal of any wall of housing 52.

The inlet end of tubular connection 86 is connected to suction line 18 as shown in FIG. 1 when the suction filtration system of this invention is assembled. Thus, when suction apparatus is assembled, piston pump 60 produces suction in line 84, causing moisture-laden air to be drawn from the filtration assembly 10 (FIG. 1) through vacuum tubes section 88 into water trap 92, where the water droplets if any are removed. The essentially water-free air stream under vacuum continues via tube sections 89 and 90 to the intake tube 81 of piston pump 60.

FIG. 5 shows metal plate 76 in detail. Metal plate 76 has two holes, 102 for head screws 78, one of which is shown in FIG. 5 Brass plate 76 has an opening in alignment with inlet tube 81. Brass plate 76 also has a semicircular cut out portion 104 so as to avoid interference with the outlet tube 82 of air suction pump 60. The inlet tube 81 of piston pump 60 is soldered or otherwise joined by a air tight seal to the brass plate 76. Outlet tube 82 is similarly joined to head 70.

Housing 52 may be of any convenient size provided it is small enough to be carried easily by hand. A preferred housing 52 may be 7.5 inches wide, 5 inches deep and 4.5 inches high. the two sections 54 and 56 of housing 52 are of approximately equal depth, i.e. each is about 2.5 inches deep. The weight of this unit may be about 5 pounds.

Unit 50 may be obtained by modifying a commercial compressor for inflating tires, say a Model MC-150 portable electric air compressor requiring 12 volts DC and made by Interdynamics, Inc. of Brooklyn, New York. Of course it is preferred to make the entire vacuum unit from scratch.

A major advantage of the vacuum unit of this invention is that piston 69 and valves 74, 75 can be lubricated without removing any wall of housing 52. To lubricate the piston and valves one simply disconnects flexible tube 90 from the inlet tube 81 of piston pump 60, and adds a small amount (say one to a few drops) of lubricating oil through inlet tube 81. The oil run down tube 81, along the bottom surfaces of head 70 to valves 74 75 and down the inside of cylinder 68 to piston 69. This oil lubricates piston 69 as it reciprocates. It also lubricates valves 74, 75.

While a preferred arrangement which makes it possible to lubricate piston pump 60 without removal of a wall of housing 52, other arrangements will be apparent to those skilled in the art. For example, the entire air inlet tube 81 and the entire vacuum line 84, including sections 89 and 90 thereof, may be placed inside housing 52, and the top wall of housing 52 provided with a pivoted door above the air inlet tube to permit access for lubrication.

An electrical system for controlling battery powered vacuum unit 50 will now be described with reference to FIG. 6. The electrical system is contained in compartment 56.

Figure 6:
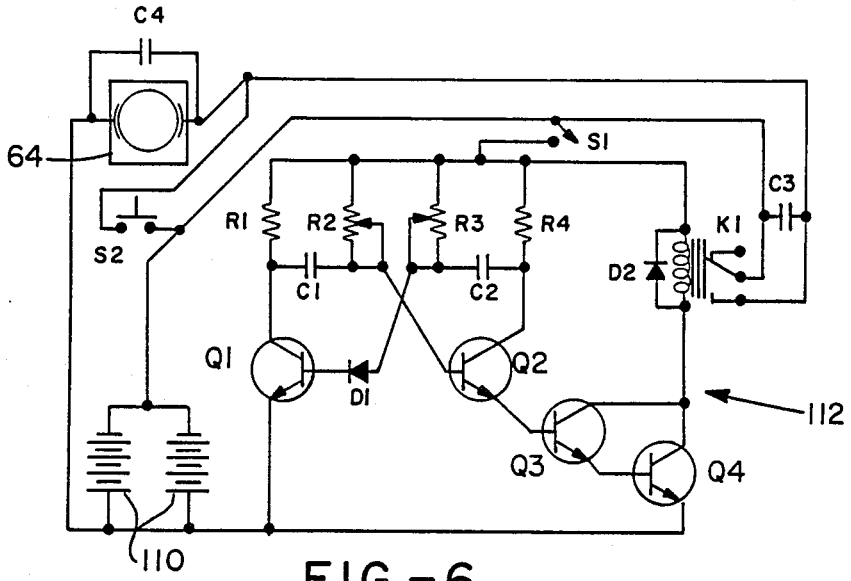
FIG. 6 is an electrical diagram of a first timer circuit for the preferred embodiment of the invention.

Referring to FIG. 6, motor 64 is powered by a battery 110, which may be a gel cell or, preferably, a plurality of dry cells or nickel-cadmium cells arranged to give a voltage from about 4.5 to about 12 volts. For field use it is important to use a bettery which has a sealed case, e.g., a gel cell, dry cells or nickel-cadmium cells, rather than a lead acid cell, because it is important to use a battery which is both light in weight and which has a dry exterior. A preferred cell arrangement for either dry cells or nickel-cadmium cells is shown in FIG. 6. This arrangement consists of two sets of cells in parallel, each set comprising four (4) cells in series. For instance, a plurality of nickel-cadmium "C" cells each having a nominal voltage of 1.25 volts and a nominal capacity of 1.1 ampere hours may be arranged as shown. Actually, the desired power needs for motor 64 can be provided with a single set of either three or four nickel-cadmium "C" cells arranged in series.

Timer circuit 112 is provided to turn motor 64 on and off in a predetermined time sequence. The presence of this timer circuit greatly extends the operating time before the cells and battery 110 must be either recharged or replaced. Timer circuit 112 comprises a first pair of transistor multivibrators, $Q_2$ and $Q_2$. The first timer circuit comprising fixed resistance $R_1$, variable resistance $R_2$ and capacitor $C_1$ controls the operation of transistor Q2. The second timer circuit comprising variable resistor $R_3$, fixed resistor $R_4$ and capacitor $C_2$ controls the operation of transistor $Q_1$. By adjusting the resistances of variable resistances $R_2$ and $R_3$, one can control the "on" times of transistors $Q_1$ and $Q_2$. Transistor $Q_1$ is connected to its timer circuit through a diode. Transistors or multi-vibrators $Q_1$ and $Q_2$, which are in the astable mode, together control the timing of timer circuit 112. Timer circuit 112 also includes transistors $Q_3$ and $Q_4$ which together constitute a darlington pair.

An on-off switch is operable from the exterior of housing 52, as may be seen in FIG. 2. When switch $S_1$ is closed, the timer circuit is in operation. Timer 112 resets to the "off" phase of the timing cycle, with $Q_1$ "on" and $Q_2$ "off". When the "off" phase is complete, $Q_1$ turns off, $Q_2$ turns on and relay $K_1$ is energized. A diode $D_2$ may be placed in parallel with relay $K_1$. A capacitor $C_3$ may be placed across the line leading to $K_1$ in order to reduce the possibility of sparks.

A push button switch $S_2$ on the exterior of housing 52 (see FIG. 2) permits manual operation of motor 74. When push button switch $S_2$ is depressed (i.e. closed), motor 64 is in full time operation. It is not controlled by the timer circuit 112. Table I below shows preferred transistor components and preferred values of resistance (in ohm) and capacitants (in microfarads) in the electrical system shown in FIG. 6.

TABLE I

| | |
|---|---|
| $Q_1$ | 2N3904 |
| $Q_2$ | 2N3904 |
| $Q_3$ | 2N3904 |
| $Q_4$ | 2N3724A |
| $D_1$ | 1N4149 |
| $D_2$ | 1N4149 |
| $R_1$ | 10,000 ohms |
| $R_2$ | 1M ohms |
| $R_3$ | 1M ohms |
| $R_4$ | 10,000 ohms |
| $C_1$ | 47 ufd |
| $C_2$ | 47 ufd |
| $C_3$ | 10 ufd |
| $C_4$ | 20 ufd |

In Table I above, "M" denotes "million". The resistances shown for variable resistances $R_2$ and $R_3$ represent maximum values.

The operation of the electrical system of the battery powered vacuum unit will now be described.

The system as shown is in a state of rest, with switches $S_1$ and $S_2$ and relay $K_1$ open. In this state transistors $Q_1$ through $Q_4$ are all off and no current flows to motor 64.

Operation of the timer circuit 112 is initiated by manually throwing switch $S_1$ to the closed position. When switch $S_1$ is closed, multivibrators $Q_1$ and $Q_2$ alternately conduct (turn on) for a specified time which is predetermined by the RC circuits $R_3$-$R_4$-$C_2$ and $R_1$-$R_2$-$C_1$ respectively. When $Q_1$ is on, $Q_2$ is off and motor 64 and suction pump 60 are in the off or "rest" mode. When $Q_2$ is on, $Q_1$ is off and power is applied to $Q_3$ and $Q_4$, which act as a darlington pair. This, in turn, applies power to the coil of relay $K_1$, causing relay $K_1$ to close. When relay $K_1$ closes, current is applied to the motor 64 and to the vacuum pump 60. The "on" duration is determined by the RC time constant of $R_1$, $R_2$ and $C_1$. The time constant of $R_3$, $R_4$ and $C_2$ determines the time that pump 60 is off. When values are as shown in Table I, the "on" and "off" times are equal. Diode $D_1$ is used to help reduce noise in the circuit. Diode $D_2$, a clamping diode, is incorporated to decrease the voltage across the coil of relay $K_1$ when it is de-energized. Capacitor $C_4$ is provided across motor 64 to give the motor a boost on start-up and, thus, assure more reliable operation. $C_3$ reduces sparks across the contacts of $K_1$.

Motor 64 can be controlled manually by closing push button $S_2$ while on-off switch $S_1$ is open.

Whenever switch $S_1$ is open, irrespective of whether switch $S_2$ is open or closed, all transistors $Q_1$, $Q_2$, $Q_3$ and $Q_4$ are off and the timer is reset.

Figure 7:
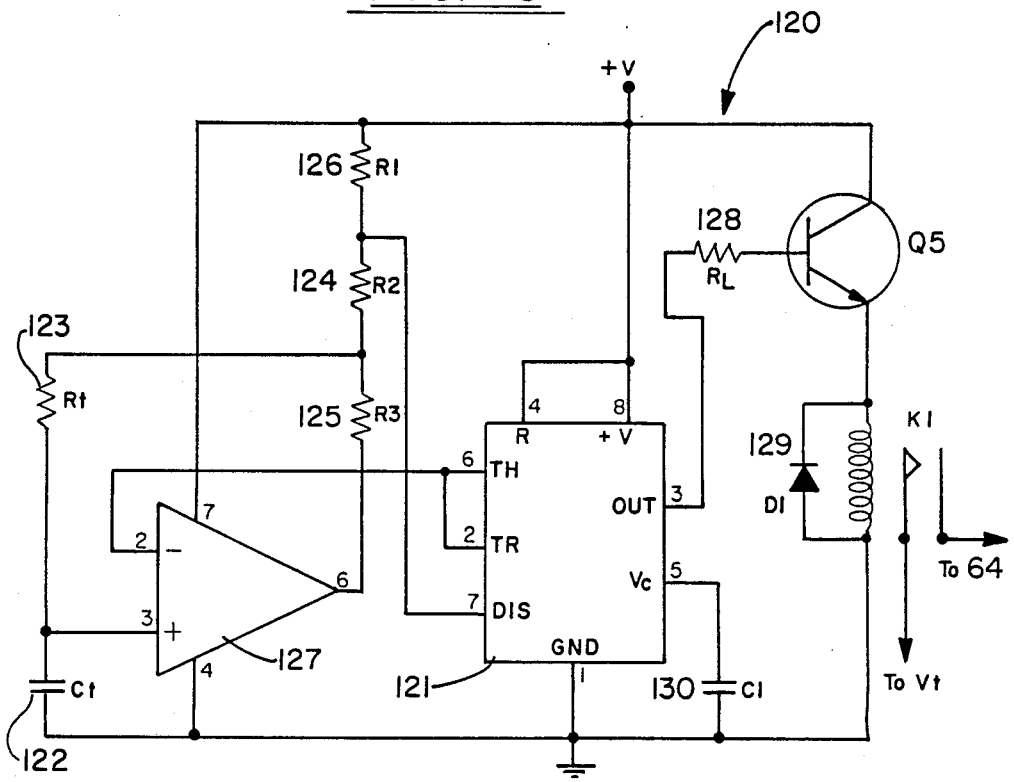
FIG. 7 is an electrical diagram of a second timer circuit for the preferred embodiment of the invention.

A second timer circuit 120 for the system of this invention is shown in FIG. 7. Here a Timer circuit 120 turns motor 64 on and off in a predetermined time sequence. It is a feature of the circuit shown in FIG. 7, to extend the operating time of the battery power, and to effectively multiply the value of the timing components themselves. The Timer circuit 120 utilizes integrated circuits to perform the timing functions. An astable type IC Timer 121 in the form of a chip is utilized in the circuit, and may be a NE-555 Timer circuit introduced by Cignetics Corporation. The IC Timer 11 is an exponential ramp type timer which consists of a transistor switch driven by a flip-flop which in turn is controlled by two voltage comparators supplied with internal preset reference voltages. The IC timer 121 comprises pins 1–8, which are described as follows: Pin 1 is the ground connection; Pin 2 is the trigger connected to the second voltage comparator; Pin 3 is the output; Pin 4 is the reset to the flip-flop; Pin 5 is the control voltage Vc; Pin 6 is the threshold connected to the first comparator; Pin 7 is the discharge from the transistor switch; and Pin 8 is the supply voltage Vt. The switch is connected across an external timing condenser 122 via the resistor 123. At a reset state, the transistor switch of the IC timer 121 is fully on and its voltage clamped to ground such that its output is at a low logic state.

A trigger pulse, supplied via pin 2 from an external oscillator to the input of one of its comparators, sets the flip-flop and releases the short-circuit across the external timing condenser 122. The condenser 122 is then charged until the voltage across it reaches the trigger level of the other comparator at which point the flip-flop is reset and the condenser 122 is discharged rapidly via the transistor switch. The timing expression for the astable timing circuit will be dependent upon the values of the external condenser 122 and resistance 123 of the output of the IC timer 121. The charging and threshold level of the comparators in the IC timer 121 are both directly proportional to the supply voltage supplied at pin 8 of the IC timer 121 and thus, the timing interval is independent of the supply voltage Vt. A pulse at the reset terminal, pin 4 of the IC chip 121, during the timing cycle will discharge the timing condenser and cause the cycle to start over again soon afterward. It is noted that pin 7 of the IC chip 121 will switch the voltage applied to the timing network between Vt and ground, but this voltage is first scaled down by the voltage divider consisting of resistors 124 and 125. A resistor 126 is interposed between resistor 125 and line voltage Vt. It is also a feature of this timing circuit to include another FET Op Amp 127, such as a 3140, which is used as a buffer for the timing network. The FET Op Amp 127 is connected to the IC timer 121 as shown to supply the threshhold and trigger voltages to the comparators of IC timer 121.

It is seen that the "cold" end of resistor 15 is returned to the output of the Op Amp 127 which has the effect of multiplying the effective value of resistance 123 by the division ratio of resistors 124 and 125. Thus, the timing expression for the astable or free-running mode is shown as follows:

$$T = \frac{R_2 + R_3}{R_3}(1.386\ Rt)$$

$$\text{For } \frac{R_2 + R_3}{R_3} = \frac{100}{1.386}, T = 100\ R_tC_t$$

In this timing expression, if $R_t$ denoted by reference numeral 123 is provided to be 150,000 ohms and $C_t$ is one microfarad, the resulting timing period would be equal to 15 seconds, being switched on for 7.5 seconds and off for 7.5 seconds. If desired, resistor 125 can be used to trim the timing period to a desired value, and the output wave form will remain essentially square as long as resistance 124 is maintained much larger than resistor 126. The output of IC chip 121 at pin 3 can be both source and sink current, and the load resistance 128 may be connected to multivibrator $Q_5$ such as an NPN-(TIP-31) to thereby turn $Q_5$ on and off according to the timing cycle. When transistor $Q_5$ is turned on, the relay $K_1$ is energized, and the pump motor is thereby activated. A diode 129 may be placed in parallel with relay $K_1$. It is also seen that the internal reference terminal of IC chip 121 at pin 5 is normally bypassed to ground by an external capacitor 130 when not in use. This circuit is adapted from a known timing circuit Model EE-103 as outlined in a paper from Heathkit Zenith Educational System, Eighth Edition, 1986, entitled "IC Timers".

This timing circuit is capable of independent operation to control the operation of motor 64, and greatly extend the operating time before the battery 110 must be either recharged or replaced. Table II below shows preferred components and values of resistance (in ohms) and capacitance in microfarads) in the electrical system shown in FIG. 7.

TABLE II

| | |
|---|---|
| Timing IC | NE-555 |
| $Q_5$ | NPN-(TIP-31) |
| $K_1$ | SPST12V Relay |
| FET OP Amp | 3140 |
| $R_1$ | 4700 ohms |
| $R_2$ | 1M ohms |
| $R_3$ | 14,000 ohms |
| $R_t$ | 150,000 ohms |
| $R_2$ | 3190 ohms |
| $C_1$ | 0.01 microfarad |
| $C_t$ | 1 microfarad |
| $D_1$ | IN4149 |

The advantage of using a timer circuit in the system of this invention is that it greatly lengthens the time the system can be in operation before the battery must be recharged or its cells replaced. Use of a rechargeable battery such as a nickel-cadmium battery is preferred even though it may not be feasible to take a battery recharger into the field. Of course, if non-chargable cells such as the conventional dry cells are used, it will be necessary to replace the batteries. Full time suction in the suction filtration system 10 can be maintained even when the motor in the vacuum unit operates intermittently. In fact, it is not necessary even to have the motor on half of the time. Of course, if the motor is to be on less than half time, appropriate adjustments must be made in the resistance or capacitances in the two RC circuits. It has been found that suction pump 60 can be in operation for as little as ⅛ of the time (e.g. 2 seconds in a 16-second cycle) and yet maintain adequate suction for filtration. Part-time operation of the battery (or batteries) is highly desirable in order to prolong battery life and minimize the frequency of battery changes in the field.

A vacuum sensor and vacuum responsive switch controlled thereby may be used instead of a timer circuit as a means for causing motor 64 and pump 60 to function whenever needed on part time battery operation. Basically, the vacuum sensor may sense the negative pressure anywhere in the vacuum line from the tubular connection 86 to the pump inlet tube 81. Whenever the vacuum is high enough the vacuum responsive switch would be open so that the electrical system would be inoperative. Whenever vacuum falls below a predetermined value, the switch would close so as to permit the electrical system and motor 64 to operate. A pressure responsive switch for controlling the operation of the electrical system and motor for a portable pump is known; see for example U.S. Pat. No. 4,063,824 to Baker et al. However, the pressure responsive switch in the present system is responsive to negative pressure on the inlet side of pump 60 which the pressure switch in Pat. No. 4,063,824 responds to a pressure drop in the exhaust line extending from the motor therein.

The system of the present invention can be operated for a long period of time before any replacement or recharging of batteries is required. By way of illustration, suppose that the battery 110 consists of either three or four "C" nickel-cadmium ("Nicad") cells in series, and that the system puts a load at 2 amperes on the batteries. Suppose further that the time 112 is such that pump 60 runs for 2 seconds out of every 16. The system would then be capable of running for 4.4 hours (264 minutes) without replacement or recharging of cells. Operations in this manner will give a vacuum of 5 inches of mercury, which is sufficient for most filtrations. Without the timer circuit 112, it will be appreciated that continuous operation for only about 33 minutes can be sustained.

If operation for more than 4.4 hours in the field is desired, it is a simple matter to bring along extra cells in the backpack, since "C" cells are small and lightweight. It would be easy enough, for example, to bring along two extra sets of cells (8 cells), so that operation could be sustained for more than 12 hours.

By using cells having a greater charge, longer operation can be sustained. For example, these cells having 1.8 ampere hours of charge are commercially available, in which case about 7.2 hours of continuous operation without change or recharging of batteries can be sustained.

The long operation times in the system of the present invention are in marked contrast to those obtained with a mechanically operated pump as described in Siegel cited supra. Siegel found that a polypropylene hand pump was efficient for only about 50 to 75 samples of 2 liters each, and that by carrying 3 pumps into the field, 150 such samples could be obtained. Of course, it is far easier to carry along extra battery cells than to bring along extra pumps. Furthermore, Siegel found the use of a portable battery powered peristaltic pump to be undesirable because operation without recharging or replacement of batteries was possible only for about 2 to 2½ hours. He further found the electrically driven system to be expensive. In contrast, the present battery powered vacuum pump is less expensive than the hand pump such as that proposed in Siegel.

The present system is compact in size and light in weight. Suitable battery powered vacuum units weighing about 10 pounds (about 4.5 kilograms) or less can easily be made; the system of the second embodiment, which is satisfactory for any field filtration, weighs only 5 pounds by way of illustration. The lightweight and compact size of course are made possible by the fact that power requirements are very low. A pump motor having a power requirement of about 50 watts or less (usually less) is quite adequate to do the job. A unit having this power will deliver maximum suction, i.e. about 21–22 inches of mercury. Actually, requirements are usually much lower. For example, satisfactory operation with only 3 Nicad cells in series, having a power output of 7.5 watts (3.75 volts and 2 amperes) is sufficient to do the job for most filtrations. This sytem will produce 5 inches of mercury suction with the motor running 12.5 percent of the time.

Another advantage of the vacuum unit of this invention is that the piston pump can be lubricated easily without removing a housing wall.

While in accordance with the patent statues, a preferred embodiment and best mode has been presented, the scope of the invention is not limited thereto, but rather is measured by the scope of the attached claims.

What is claimed is:

1. A portable vacuum unit for use in field filtrations, and unit comprising:

(a) a housing having therein a generally upright piston pump and a direct current electric motor for driving said pump, said pump including a cylinder having a reciprocable piston therein, an inlet port for air under reduced pressure and an outlet port for exhausting air to the atmosphere;

(b) a tubular connection extending through a wall of said housing for attachment of a suction line;

(c) a vacuum line extending from said tubular connection to said inlet port of said piston pump, said vacuum line including a water trap;

(d) means for introducing a lubricant into said cylinder without removal of any wall of said housing;

(e) means for allowing automatic intermittent operation of said motor during operation of said vacuum unit; and (f) means for maintaining full time suction in said vacuum unit during said intermittent operation of said motor.

2. A vacuum unit according to claim 1 in which said piston pump further includes an air inlet tube joined to the exterior of said cylinder in alignment with said inlet port and said vacuum line includes a flexible section removably attached to said air inlet tube, said inlet tube and said flexible section together providing said means for introducing a lubricant without removal of any wall of said housing.

3. A vacuum unit according to claim 2 in which said air inlet tube extends to the exterior of said housing, so that the joint between said inlet tube and said flexible section removably attached thereto is on the exterior of said housing.

4. A vacuum unit according to claim 1 in which said water trap is inside said housing.

5. A vacuum unit according to claim 1 in which said vacuum line further includes a check valve.

6. A vacuum unit according to claim 1 further comprising a dry battery in said housing for providing power to said motor.

7. A vacuum unit according to claim 1 in which said means for allowing automatic intermittent operation comprises a timer circuit housed in said housing for turning said motor on and off in predetermined time sequence during operation of said vacuum unit.

8. A vacuum unit according to claim 7 in which said timer circuit includes a pair of multi-vibrators, each controlled by resistor means and a capacitor forming an RC circuit and a pair of transistors constituting a darlington pair.

9. A vacuum unit according to claim 7 further comprising partition means dividing the interior of said housing into two compartments, one of said compartments containing said piston pump, said electric motor and said water trap, the other of said compartments containing said battery and said timer circuit.

10. A vacuum unit according to claim 7 in which said timer circuit includes an integrated circuit including a transistor switch driving by a flip-flop which is controlled via voltage comparators to initiate operation of said motor when said transistor switch is turned on.

11. A vacuum unit according to claim 10, wherein said voltage comparators are supplied with threshhold and trigger voltages from an ramp forming part of said timer circuit.

12. A vaccum unit according to claim 10, wherein said means for allowing automatic intermittent operation of said motor includes a pressure responsive switch disposed in said vacuum line to sense the negative pressure on said inlet port of said pump to render said motor inoperative when the vacuum of the system is greater than a predetermined amount.

13. A vacuum unit according to claim 1, said vacuum unit weighing not more than about 10 pounds and said motor having a power requirement not in excess of about 50 watts.

14. A portable suction filtration apparatus comprising:

(a) a first vessel for unfiltered liquid, a fine presize filter, a suction port below said filter, and a receiving vessel for filtered liquid;

(b) a portable vacuum unit as claimed in claim 1, and (c) a suction line connected to said suction port and to the tubular connection of said vacuum unit.

15. A portable suction filtration apparatus according to claim 14 in which said piston pump of said vacuum unit further includes an air inlet tube joined to the exterior of said cylinder in alignment with said inlet part, and wherein said vacuum line of said vacuum unit includes a flexible section removably attached to said air inlet tube, said inlet tube and said flexible section together providing said means for introducing a lubricant without removal of any wall of said housing.

16. A portable suction filtration apparatus according to claim 14, in which said vacuum unit further comprises partition means dividing the interior of said housing into two compartments, one of said compartments containing said piston pump, said electric motor and said water trap, the other of said compartments containing a dry battery for powering said motor and a timer circuit for turning said motor on and off in predetermined time sequence.

17. A portable suction filtration apparatus according to claim 14 in which said vacuum unit weighs no more than about 10 pounds and the electric motor therein has a power requirement not in excess of about 50 watts.

18. A portable vacuum unit capable of being carried from place to place by hand, said unit comprising:

(a) a vacuum pump comprising an inlet port for air under reduced pressure and an outlet port for exhausting air to the atmosphere;

(b) a direct current motor for driving said vacuum pump;

(c) a vacuum line connected at its outlet end to said inlet port, and said vacuum line including an inlet connection and a water trap;

said vacuum pump, motor and water trap being housed in a single portable housing; and (d) a timer circuit for turning said motor on and off in predetermined timed sequence, said timer circuit being housed in said housing and including a pair of multi-vibrators, each controlled by resistor means and a capacitor forming an RC circuit and a pair of transistors constituting a darlington pair.

* * * * *